US005279350A

United States Patent [19]

Gerber

[11] Patent Number: 5,279,350

[45] Date of Patent: Jan. 18, 1994

[54] APPARATUS AND METHOD FOR MAGNETICALLY CONFINING MOLTEN METAL USING CONCENTRATING FINS

[75] Inventor: Howard L. Gerber, Flossmoor, Ill.

[73] Assignee: Inland Steel Company, Chicago, Ill.

[21] Appl. No.: 34,240

[22] Filed: Mar. 22, 1993

Related U.S. Application Data

[63] Continuation-in-part of Ser. No. 902,559, Jun. 22, 1992, Pat. No. 5,197,534, which is a continuation of Ser. No. 739,223, Aug. 1, 1991.

[51] Int. Cl.[5] ..... B22D 27/02; B22D 11/06

[52] U.S. Cl. ..... 164/467; 164/503; 164/428; 164/480

[58] Field of Search ..... 164/467, 503, 428, 480

[56] References Cited

U.S. PATENT DOCUMENTS

| | | | |
|---|---|---|---|
| 4,020,890 | 5/1977 | Olsson . | |
| 4,762,653 | 8/1988 | Senillou et al. | 264/22 |
| 4,776,980 | 10/1988 | Ruffini | 252/513 |
| 4,936,374 | 6/1990 | Praeg | 164/503 |
| 4,974,661 | 12/1990 | Lari et al. | 164/503 |
| 4,986,339 | 1/1991 | Miyazawa | 164/466 |
| 5,197,534 | 3/1993 | Gerber et al. | 164/467 |

FOREIGN PATENT DOCUMENTS

| | | | |
|---|---|---|---|
| 60-106651 | 6/1985 | Japan | 11/10 |
| 62-104653 | 5/1987 | Japan | 11/6 |

OTHER PUBLICATIONS

J. S. LaMonte and M. R. Black, "How Flux Field Concentrators Improve Inductor Efficiency," *Heat Treating*, Jun., 1989, pp. 30–31.

"Induction Hardening with a Flux Field Concentrator," *Electrical Power Research Institute Technical Application*, vol. 1, No. 11, 1987.

"Guarantee Only from Fluxtrol," an advertisement mailed by Fluxtrol of unknown date.

*Primary Examiner*—Kuang Y. Lin

*Attorney, Agent, or Firm*—Marshall, O'Toole, Gerstein, Murray & Borun

[57] ABSTRACT

A magnetic confining apparatus prevents the escape of molten metal through the open side of a vertically extending gap between two horizontally separated members and in which the molten metal is located. The apparatus includes a current conducting coil for generating a horizontal magnetic field and non-magnetic fins for concentrating the current in the surface of the coil which is closest to the open side of the gap. The magnetic field generated by the apparatus extends through the open side of the gap and exerts a confining pressure against the molten metal in the gap.

35 Claims, 8 Drawing Sheets

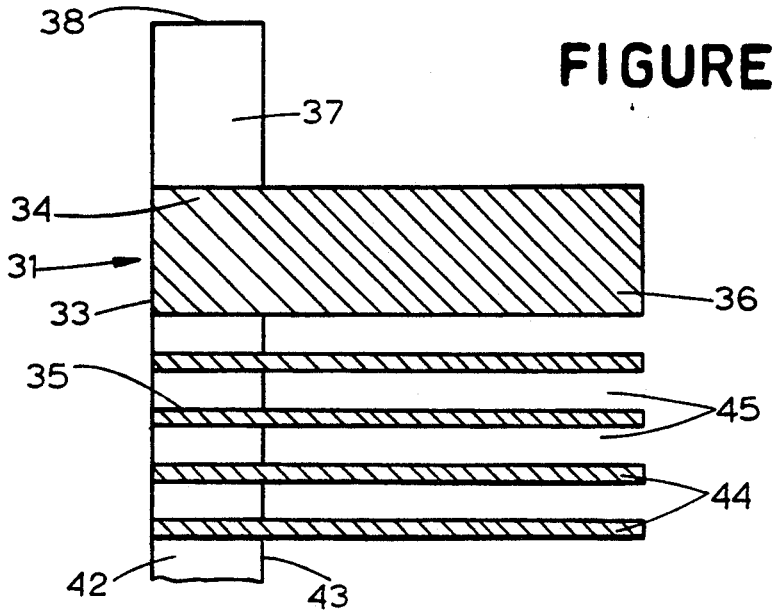
FIGURE 7
FIGURE 8
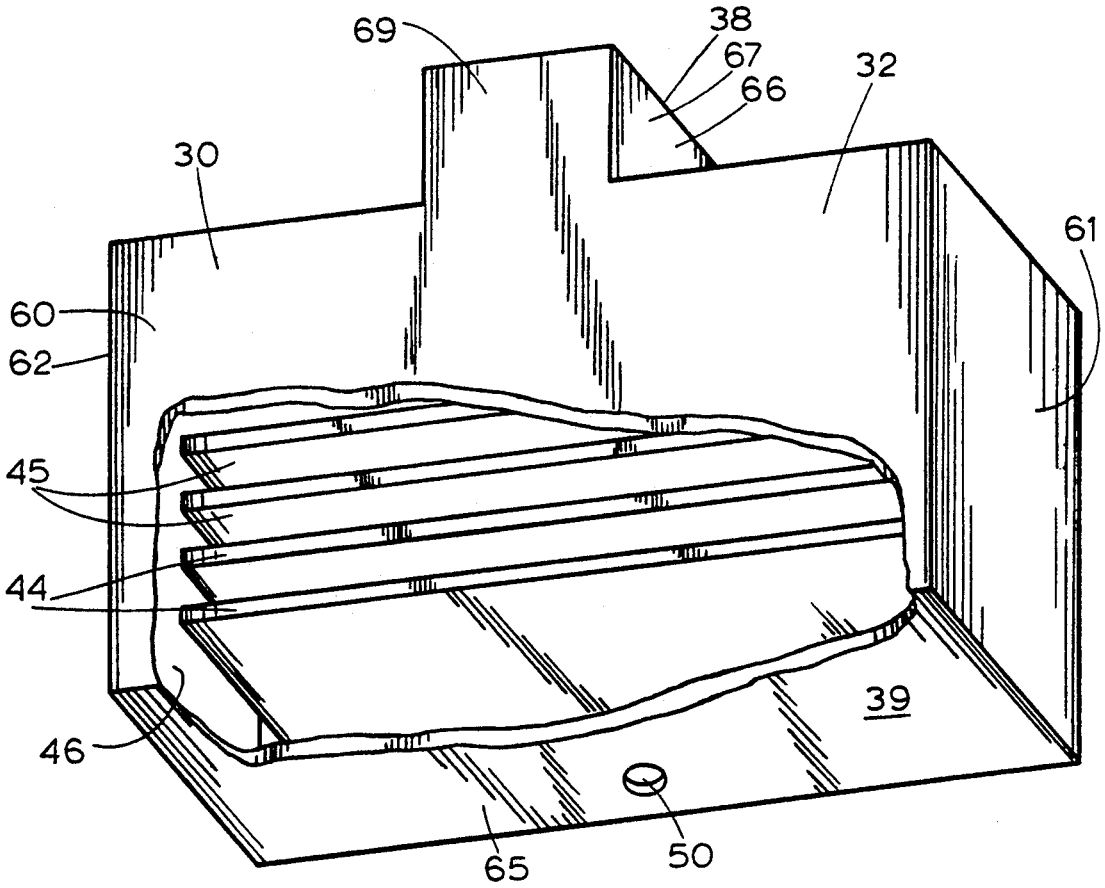

FIGURE 11
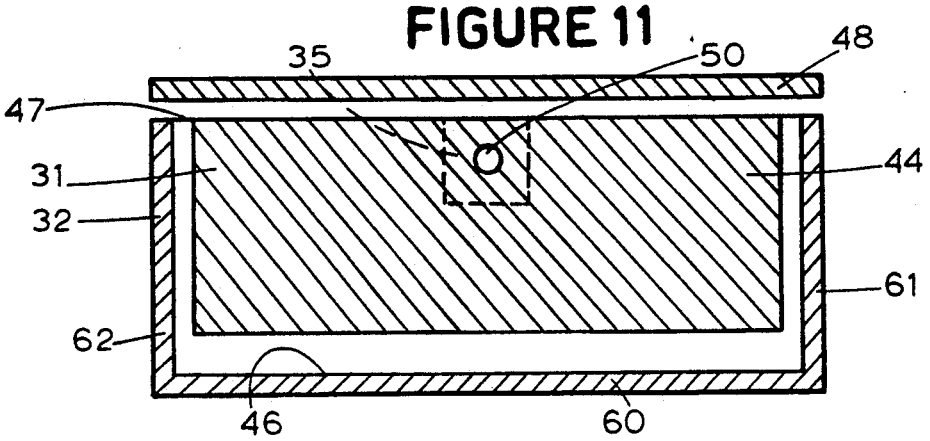
FIGURE 12
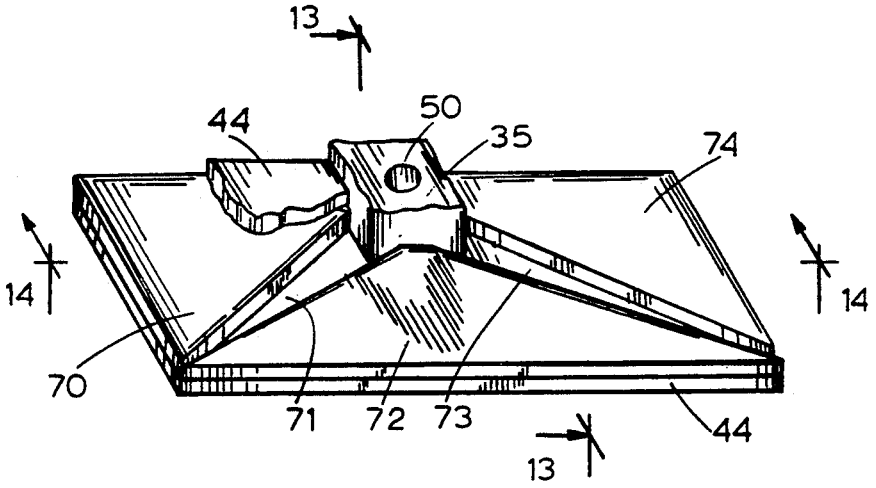
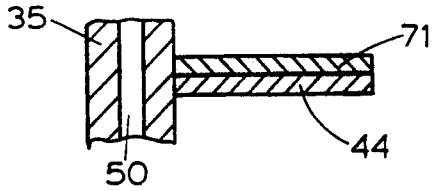
FIGURE 13
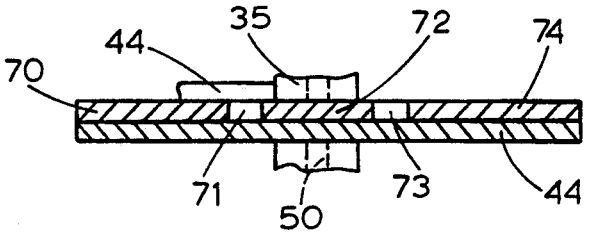
FIGURE 14

FIGURE 15
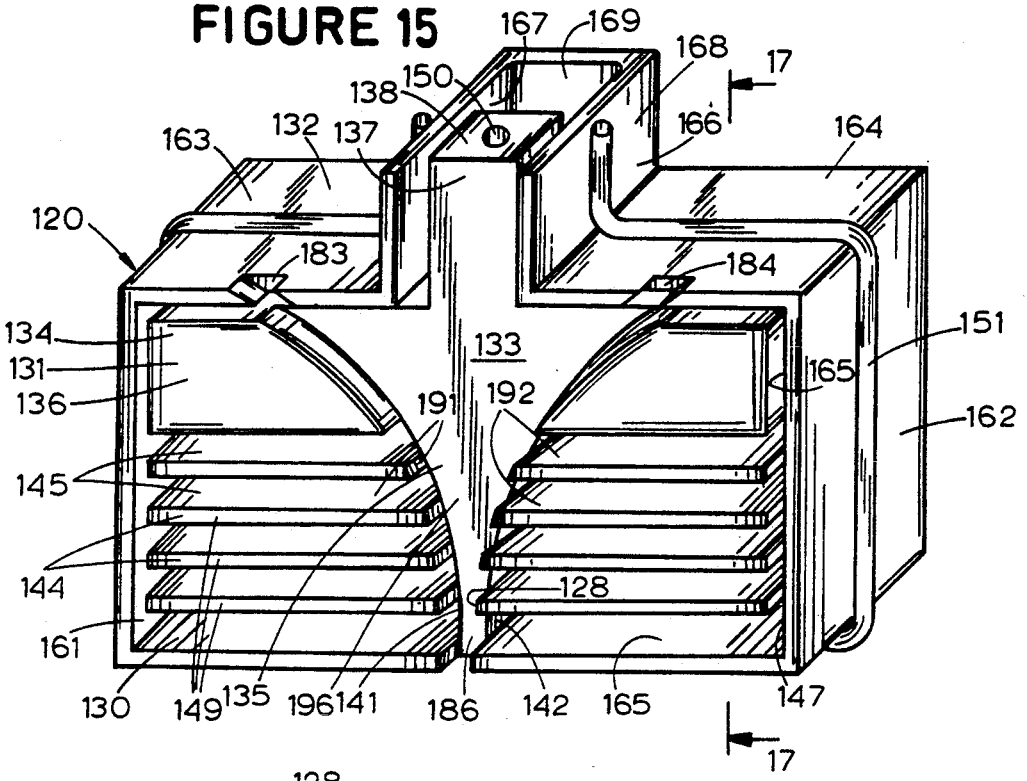
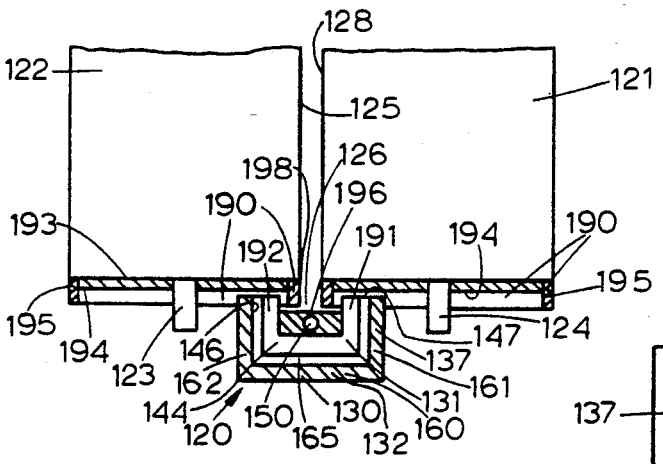
FIGURE 16
FIGURE 17
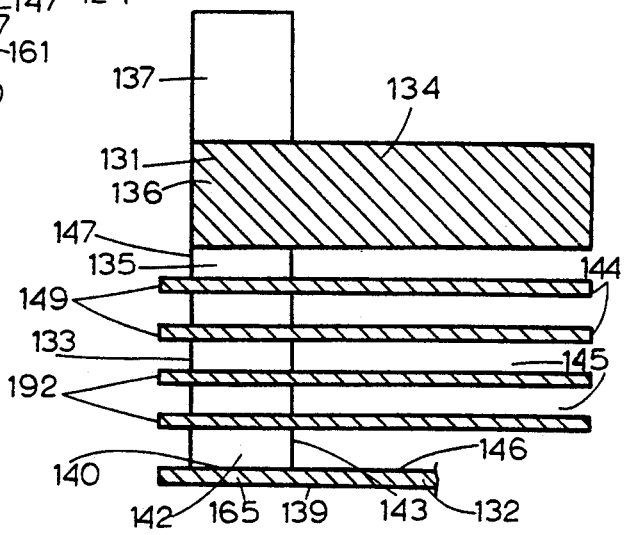

APPARATUS AND METHOD FOR MAGNETICALLY CONFINING MOLTEN METAL USING CONCENTRATING FINS

This is a continuation-in-part of application Ser. No. 07/902,559 (now issued as U.S. Pat. No. 5,197,534) filed Jun. 22, 1992, in turn a continuation of application Ser. No. 07/739,223 filed Aug. 1, 1991, and the disclosures of those applications are incorporated herein by reference.

BACKGROUND OF THE INVENTION

The present invention relates generally to an improvement on the apparatuses and methods for magnetically confining molten metal which are disclosed in said antecedent applications. More particularly, this application discloses an improved method and apparatus for preventing the escape of molten metal through the open side of a vertically extending gap between two horizontally separated members and in which the molten metal is located.

The present invention is intended to operate in the same environment as that disclosed in the parent application, e.g., a twin-roll, continuous-casting apparatus. While the apparatus disclosed in the parent application is effective in preventing molten metal from escaping through the open side of a gap between two horizontally separated casting rollers, the improved apparatus of the present invention is designed to accomplish the same task more efficiently.

The twin-roll continuous casting environment in which the present invention is intended to operate typically comprises a pair of horizontally spaced rolls mounted for rotation in opposite rotational senses about respective horizontal axes. The two rolls define a horizontally extending gap therebetween for receiving the molten metal. The gap defined by the rolls tapers in a downward direction. The rolls are cooled, and in turn cool the molten metal as the molten metal descends through the gap.

The gap has horizontally spaced, open opposite ends adjacent the ends of the two rolls. The molten metal is unconfined by the rolls at the open ends of the gap. To prevent molten metal from escaping outwardly through the open ends of the gap, mechanical dams or seals have been employed.

Mechanical dams have drawbacks because the dam is in physical contact with both the rotating rolls and the molten metal. As a result, the dam is subject to wear, leaking, and breakage, and can cause freezing and large thermal gradients in the molten metal. Moreover, contact between the mechanical dam and the solidifying metal can cause irregularities along the edges of metal strip cast in this manner, thereby offsetting the advantages of continuous casting over the conventional method of rolling metal strip from a thicker, solid entity.

The advantages obtained from the continuous casting of metal strip, and the disadvantages arising from the use of mechanical dams or seals are described in more detail in Praeg U.S. Pat. No. 4,936,374 and in Lari et al. U.S. Pat. No. 4,974,661, and the disclosures of each of these patents are incorporated herein by reference.

To overcome the disadvantages inherent in the employment of mechanical dams or seals, efforts have been made to contain the molten metal at the open end of the gap between the rolls by employing an electromagnet having a core encircled by a conductive coil through which an alternating electric current flows and having a pair of magnet poles located adjacent the open end of the gap. The magnet is energized by the flow of alternating current through the coil, and the magnet generates an alternating or time-varying magnetic field extending across the open end of the gap between the poles of the magnet. The magnetic field can be either horizontally disposed or vertically disposed, depending upon the disposition of the poles of the magnet. Examples of magnets which produce a horizontal field are described in the aforementioned Praeg U.S. Pat. No. 4,936,374; and examples of magnets which produce a vertical magnetic field are described in the aforementioned Lari et al. U.S. Pat. No. 4,974,661.

The alternating magnetic field induces eddy currents in the molten metal adjacent the open end of the gap creating a repulsive force which urges the molten metal away from the magnetic field generated by the magnet and thus away from the open end of the gap.

The static pressure force urging the molten metal outwardly through the open end of the gap between the rolls increases with increased depth of the molten metal, and the magnetic pressure exerted by the alternating magnetic field must be sufficient to counter the maximum outward pressure exerted on the molten metal. A more detailed discussion of the considerations described in the preceding sentence and of the various parameters involved in those considerations are contained in the aforementioned Praeg and Lari et al. U.S. patents.

Another expedient for containing molten metal at the open end of a gap between a pair of members is to locate adjacent the open end of the gap a coil through which an alternating current flows. This causes the coil to generate a magnetic field which induces eddy currents in the molten metal adjacent the open end of the gap resulting in a repulsive force similar to that described above in connection with the magnetic field generated by an electromagnet. Embodiments of this type of expedient are described in Olsson U.S. Pat. No. 4,020,890, and the disclosure therein is incorporated herein by reference.

The use of a coil to directly generate the magnetic field adjacent the open end of the gap is more efficient than the use of an electromagnet because when employing an electromagnet, the coil is used to energize the core of a magnet through which magnetic flux must travel to the magnet poles which then generate a magnetic field adjacent the open end of the gap. As a result, there is socalled "core loss" when a coil is employed to energize an electromagnet; but core loss is not a significant factor when the coil is employed to directly generate the magnetic field at the open end of the gap. Even in that case, however, it is important to minimize the energy dissipated by the coil in producing a magnetic field sufficiently strong to confine the molten metal.

A drawback to the latter expedient is that the coil must be placed quite close to the open end of the gap in order to generate a magnetic field which will contain the molten metal there. In the expedient employing an electromagnet, the coil can be relatively remote from the open end of the gap. The closer the coil is to the molten steel, the more severe the thermal conditions to which the coil is subjected. Another drawback to the expedient employing a coil for directly generating the magnetic field at the open end of the gap is that part of the magnetic field is radiated in a direction away from the open end of the gap, thereby decreasing the efficiency of the coil. The problem described in the preceding sentence can also be a problem when employing any electromagnet.

The parent application, Gerber, et al., Ser. No. 07/902,559, discloses a magnetic confining apparatus which employs a single turn coil to directly generate a magnetic field that extends through and is confined substantially to the open side of the gap. In that apparatus, magnetic material encloses all but the front working surface of the front half of the coil, and that magnetic material is used to concentrate current in the working surface of the coil that faces the open side of the gap.

Although the use of such magnetic material is effective in concentrating current in the working surface, it also has several practical limitations.

First, eddy currents induced in the magnetic material by the changing magnetic field produce energy losses and resultant heating of the magnetic material. This effect is minimized by fabricating the magnetic material from thin laminations, but fabrication then becomes more difficult and costly.

Second, the efficiency of the embodiment using magnetic material is further limited by magnetic hysteresis loss in the magnetic material. Magnetic hysteresis loss, a condition which is well-known to those of ordinary skill in the art, refers to energy that is dissipated in the form of heat in magnetic material when a time-varying magnetic field is applied to the magnetic material. Because this energy loss is characteristic of any magnetic material, a molten metal confining apparatus that does not employ magnetic material is desirable.

Each of the above-described energy losses causes heating of the magnetic material. If the current flowing in the coil is strong enough, the heat generated by the above-described energy losses can be severe enough to cause irreversible damage to the magnetic material. Accordingly, there is a limit on the amount of current that can be conducted through the coil, and as a result, there is a corresponding limit on the magnetic confining pressure that can be exerted by the coil. Thus, there is a limit on the amount of molten metal that may be confined by the coil employing magnetic material, in the manner described above, to concentrate current in the working surface. To confine molten metal in amounts exceeding this limit, it is necessary to employ a coil that does not employ magnetic material in such a manner.

SUMMARY OF THE INVENTION

The drawbacks and deficiencies of the prior art expedients described above are eliminated by an apparatus and method in accordance with the present invention, which is an improvement over the invention disclosed in parent application Ser. No. 07/902,559.

The operation of this improved apparatus is essentially the same as that of the apparatus disclosed in the parent application, in a general sense, but the coil, used to generate the magnetic field which confines the molten metal within the gap, is modified to include fin-like structures on that part of the coil, termed the front coil part, that is directly opposite the open side of the gap. The fin-like structures extend laterally outwardly from all surfaces of the front coil part except the working surface, which faces the open side of the gap.

The fin-like structures effectively concentrate current flowing in the front coil part in the working surface facing the open side of the gap. This, in turn, produces an increased magnetic flux concentration in the space between the working surface of the front coil part and the molten metal, thereby strengthening the confining pressure exerted on the molten metal in the gap.

Typically, alternating current is conducted through the coil to generate the horizontal magnetic field which extends from the working surface of the coil through the open side of the gap to the molten metal.

Dissipation of the magnetic field in a direction away from the open side of the gap is prevented by restricting the magnetic field generated by the coil substantially to the open side of the gap. This is accomplished by configuring the rear coil part, a nonmagnetic electrical conductor, not only to act as part of the return path for the current flowing through the front coil part, but also to confine the magnetic field substantially to the open side of the gap.

The working surface of the front coil part is configured to conform to the tapered shape of the gap so as to increase the magnetic pressure against the molten metal in accordance with increasing static pressure (i.e., depth) of the molten metal in the gap.

In a variant of the present invention, pieces of magnetic material are inserted in planar spaces vertically separating the fin-like structures to more fully spread out magnetic flux in the planar spaces between fin-like structures.

In another variance of the present invention, the fin-like structures include first and second portions which protrude forward of the coil to define a recess. The recess, in turn, receives portions of circumferential lips extending from the ends of the twin casting rolls with which the coil of the present invention is intended to be used.

Other features and advantages are inherent in the method and apparatus claimed and disclosed or will become apparent to those skilled in the art from the following detailed description in conjunction with the accompanying drawings.

BRIEF DESCRIPTION OF THE DRAWINGS

FIG. 7 is a fragmentary sectional view taken along line 7—7 in FIG. 5.

FIG. 8 is a rear perspective of the apparatus, partially cut away;

FIG. 11 is a sectional view taken along 11—11 in FIG. 6;

FIG. 12 is a fragmentary perspective illustrating a portion of an alternative embodiment of apparatus;

FIG. 13 is a sectional view taken along line 13—13 in FIG. 12;

FIG. 14 is a sectional view taken along line 14—14 in FIG. 12;

FIG. 15 is a perspective of an alternative embodiment of the apparatus;

FIG. 16 is a plan view, partially in section, illustrating the embodiment of FIG. 15 associated with a pair of rolls of a continuous strip caster;

FIG. 17 is a sectional view taken along line 17—17 in FIG. 15, with a portion of the rear coil part removed.

DETAILED DESCRIPTION

Figure 2:
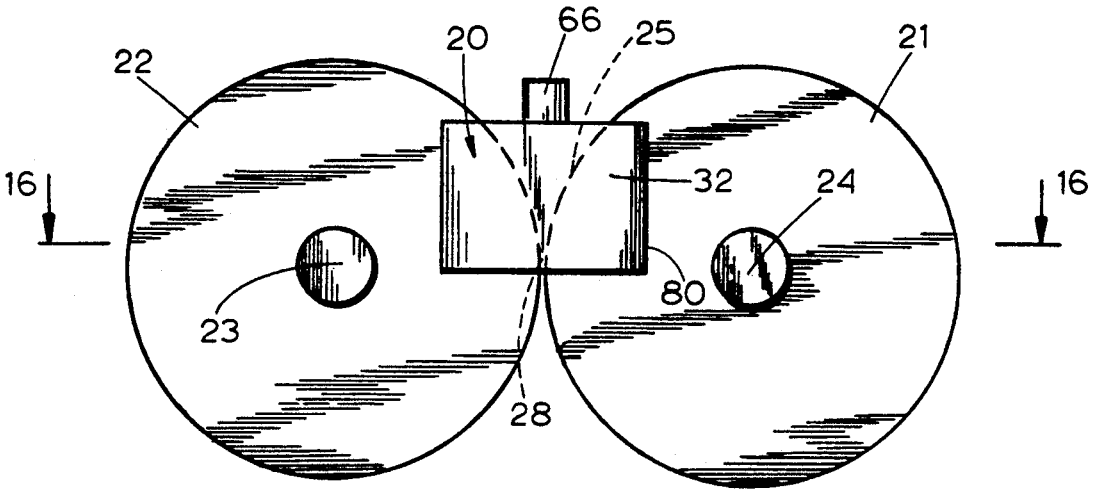
FIG. 2 is an end view of the apparatus and rolls of FIG. 1.
Figure 3:
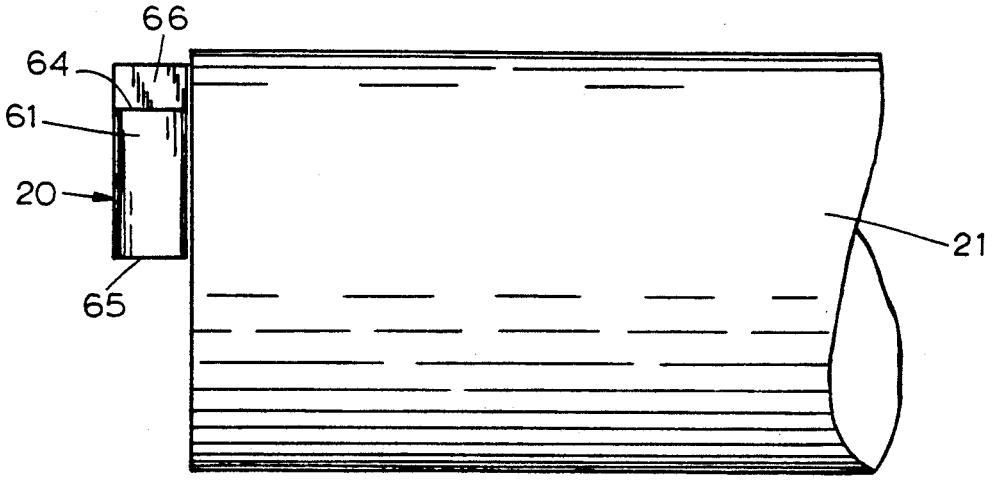
FIG. 3 is a side view of the apparatus and rolls of FIG. 1.

Referring initially to FIGS. 1–4, indicated generally at 20 is a magnetic confining apparatus constructed in accordance with an embodiment of the present invention. Apparatus 20 produces a horizontally extending magnetic field which prevents the escape of molten metal through the open side 26 of a vertically extending gap 25 located between two horizontally separated, cylindrical metal rolls 21, 22 in a continuous strip caster. Due to the cylindrical shape of rolls 21, 22, the gap 25 narrows in width from the uppermost level of the gap downward to a level of minimum width at the nip 28 between the rolls (FIGS. 2 and 5).

Rolls 21, 22 rotate in respective opposite, rotational senses about respective axes 23, 24. Molten metal is normally contained in gap 25. Rolls 21, 22 are cooled, in a conventional manner not disclosed here, and as molten metal descends vertically through gap 25, the metal is cooled and solidified into a metal strip 27 which descends downwardly from nip 28 (FIG. 5).

But for confining apparatus 20, molten metal in gap 25 would escape through open side 26 of gap 25. Although only one open side 26 of gap 25, and one confining apparatus 20 is shown in the figures, it should be understood that there is an open side 26 at each end of gap 25 and an apparatus 20 at each open side 26.

Referring now to FIGS. 4–8, apparatus 20 comprises a current conducting coil 30 including a front coil part 31 and a rear coil part 32. Alternating current is conducted through coil 30, in a manner to be subsequently described, and this directly generates a horizontal magnetic field which, because of the proximity of coil 30 to open side 26 of gap 25, extends from the front surface 33 of coil 30, through open side 26 of gap 25, to the molten metal in the gap.

The coil 30 and its associated structure are located sufficiently close to open side 26 of gap 25 to enable the directly generated magnetic field to contain the molten metal within the gap. The possible adverse thermal effects of such close proximity to the hot, molten metal are offset by the employment of conventional protective structure, such as that described in detail in parent application Ser. No. 07/902,559, to protect the coil. For example, coil 30 may be insulated from the heat generated by the molten metal by positioning a refractory member 48 between coil 30 and open side 26 of gap 25 (FIGS. 6 and 11).

Figure 9:
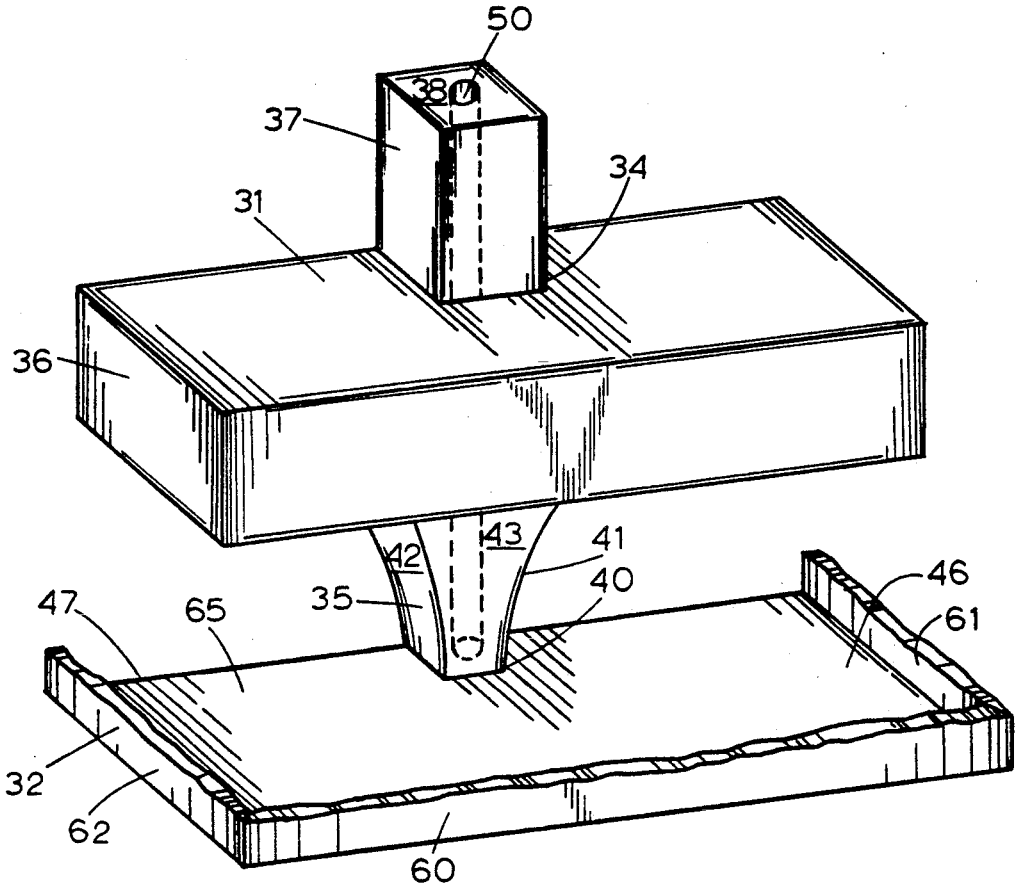
FIG. 9 is a fragmentary, cut-away perspective of a portion of the apparatus with other portions of the apparatus removed for clarity of illustration.

Referring now to FIGS. 4–9, in one embodiment of the present invention, front and rear coil parts 31, 32 are integral, and together they form coil 30 which is, in fact, a one-piece structure. The integral connection of front coil part 31 to rear coil part 32 is indicated at 40 in FIGS. 4 and 9. Front coil part 31 includes fins 44 to be described in more detail below; however, FIG. 9 depicts the structure of one-piece coil 30 with fins 44 removed in order to clearly show lower body portion 35 of front coil part 31 and the integral connection 40 between front coil part 31 and rear coil part 32. In an alternative embodiment, front coil part 31 and rear coil part 32 are separate structures electrically and structurally joined together in any conventional manner.

Front coil part 31 comprises an upper body portion 34 and a lower body portion 35. The upper body portion 34, in turn, comprises a rectangular, mostly solid upper body structure 36 from which a neck 37 extends upwardly and integrally. Neck 37, upper body structure 36, and lower body portion 35 have respective front surface portions which are contiguous and coplanar so as to form an uninterrupted front coil surface 33. As shown in FIG. 5, lower body portion 35 extends downwardly from upper body structure 36 and has a lateral width which decreases in a downward direction in conformity with the narrowing in width of open side 26 of gap 25.

Figure 6:
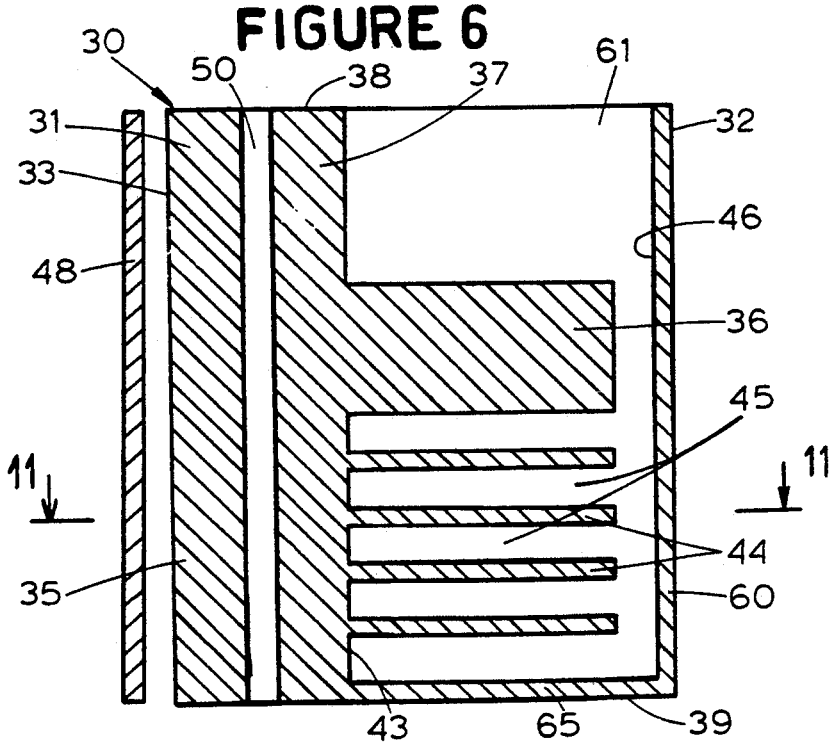
FIG. 6 is a sectional view taken along line 6—6 in FIG. 4.
Figure 10:
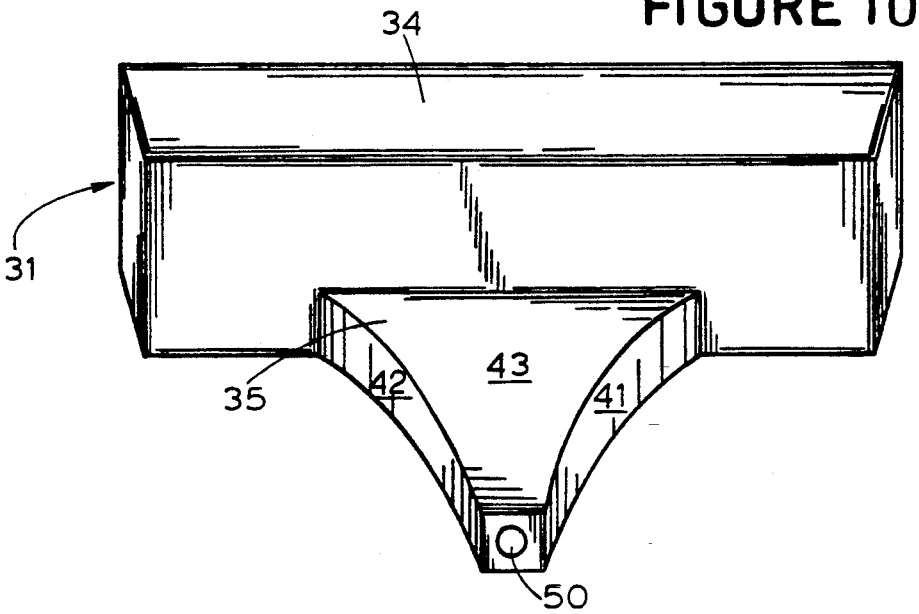
FIG. 10 is a fragmentary perspective of the front coil part of the apparatus with portions of the front coil part removed for clarity of illustration.

Lower body portion 35 has two opposed side surfaces 41, 42 and a rearward facing surface 43 (FIGS. 6 and 10). Contiguous with and extending laterally outward from side surfaces 41, 42 and rearward from surface 43 are a plurality of fins 44 vertically separated by planar spaces 45. The fins are planar members that are integral with lower body portion 35, and they extend away from open side 26 of gap 25.

Figure 1:
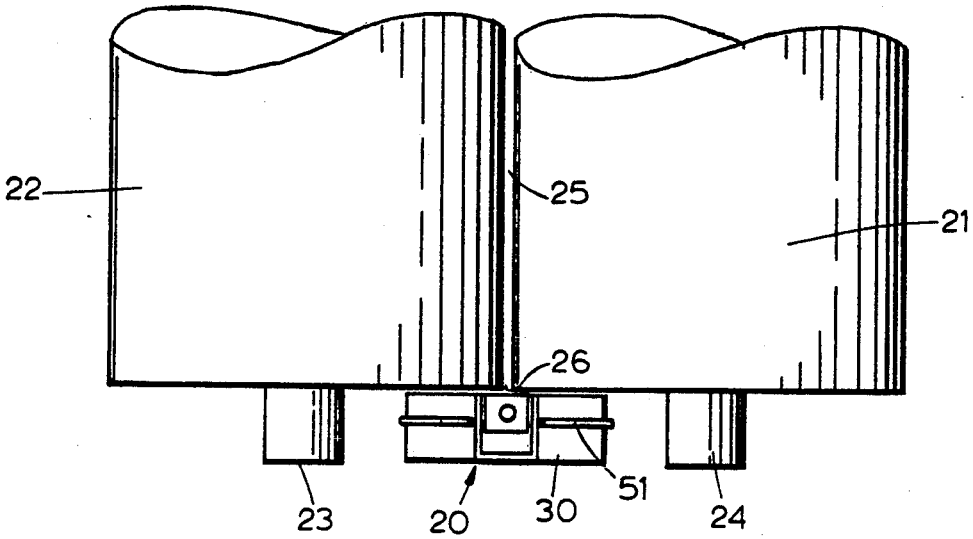
FIG. 1 is a plan view showing an embodiment of an apparatus in accordance with the present invention associated with a pair of rolls of a continuous strip caster.
Figure 4:
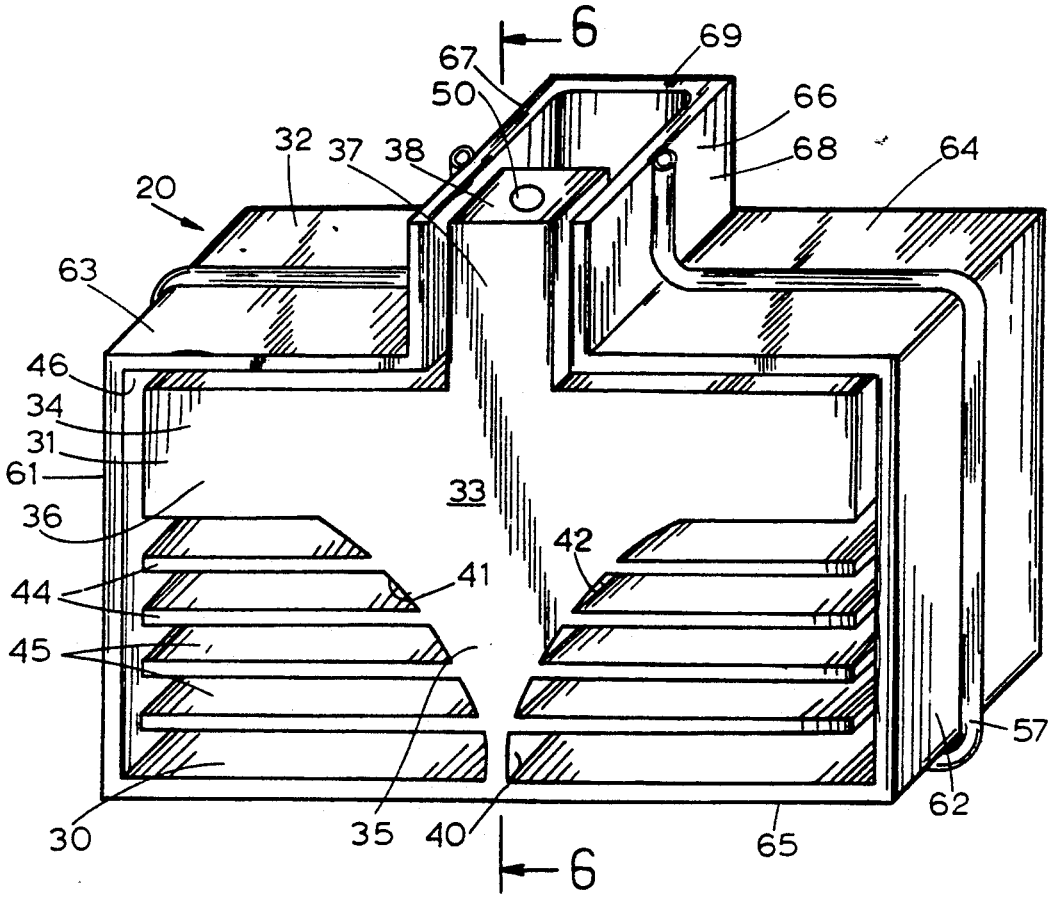
FIG. 4 is a perspective of the apparatus.
Figure 5:
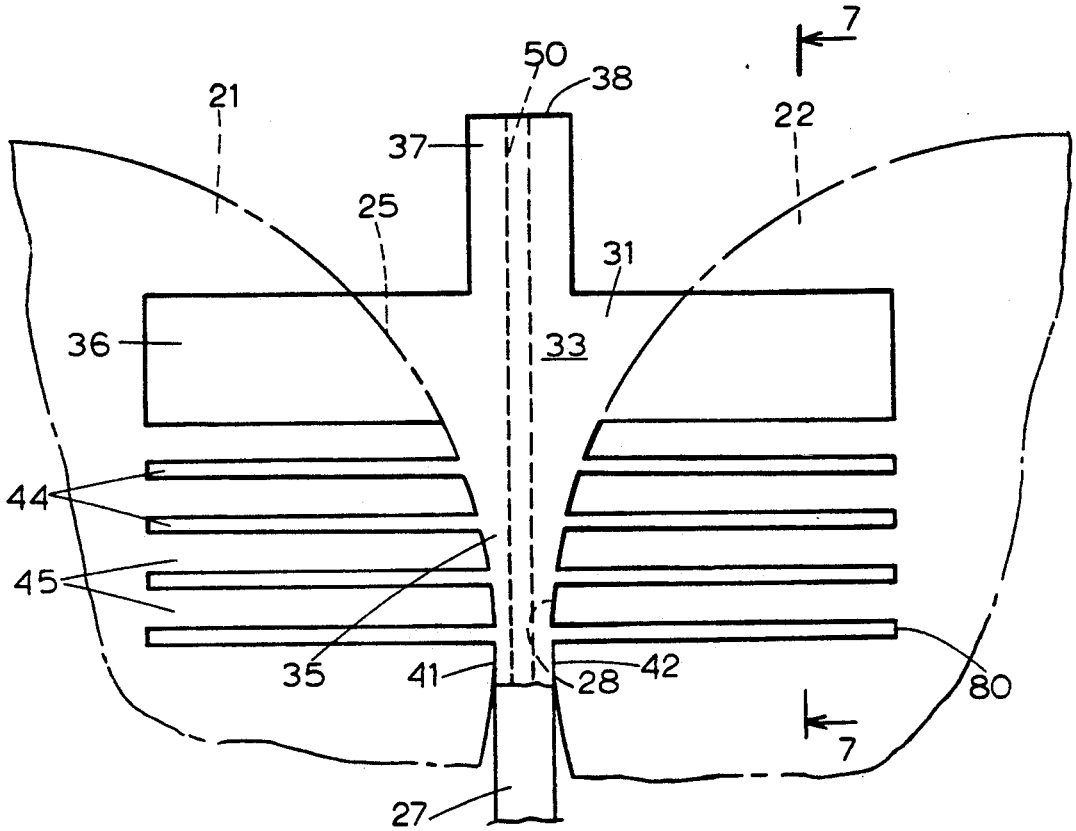
FIG. 5 is a front end view of a portion of the apparatus.

Referring now to FIGS. 4, 8, and 11, rear coil part 32 comprises a box-like structure having a rear wall 60, side walls 61, 62, top wall portions 63, 64, and a bottom wall 65. Walls 60–65 of rear coil part 32 define a cavity 46 that has an open front 47 and that is sized to receive front coil part 31 (FIGS. 9 and 11). Front surface 33 of front coil part 31 thus remains uncovered by rear coil part 32 and faces open side 26 of gap 25 through open front 47 of cavity 46. Cavity 46 has a shape that conforms substantially to the shape of front coil part 31. Cavity 46 is larger than front coil part 31, however, so that fins 44 do not contact the inner surfaces of walls 60. 65 of rear coil part 32 (FIG. 11). Extending upwardly and integrally from rear coil part 32 is a collar portion 66 including collar side walls 67, 68 and collar rear wall 69. Walls 67–69 of collar 66 define an extension 72 of cavity 46. Cavity extension 72 has a shape that conforms substantially to the shape of neck 37 of front coil part 31. Cavity extension 72 receives neck 37, but collar 66 does not contact neck 37.

To further illustrate the structure of the present invention, FIG. 8 depicts a rear view of coil 30, wherein rear coil part 32 is partially cut away to expose fins 44 of front coil part 31. As indicated above, fins 44 are spaced apart from the inner surfaces of rear coil part 32 so that electric current flowing in the coil will flow downwardly through lower body portion 35, where it is concentrated in front surface 33, and then flows to rear coil part 32.

Coil 30 is positioned adjacent rolls 21, 22 so that the front surface of lower body portion 35 is directly opposite open side 26 of gap 25. Coil 30 is dimensioned so that a portion 80 of coil 30 extends below roll nip 28, and the location of the lowermost fin 44 is also below nip 28 (FIGS. 2 and 5). Current flowing in portion 80 contributes to the intensity of the magnetic field in open side 26 of gap 25 just a does current flowing in the portion of coil 30 which is above nip 28. Further, because the contribution made by portion 80 to the magnetic field in open side 26 of gap 25 is greatest at nip 28, the extension of coil 30 below nip 28 effectively strengthens the magnetic field at nip 28. The strengthened magnetic field, in turn, augments the magnetic confining pressure exerted on the molten metal in gap 25, at nip 28, where the static pressure urging the molten metal out of open side 26 of gap 25 is greatest.

Coil 30 may be supported in the desired position relative to the continuous casting rolls, and connected to a source of alternating current, in any conventional manner, e.g., in a manner similar to that described in detail in parent application Ser. No. 07/902,559.

An alternating current is conducted to front coil part 31, downwardly through front coil part 31, then upwardly through rear coil part 32 which is conductively and integrally attached to front coil part 31. The current exits coil 30 through the conventional connecting structure mentioned above. As the alternating current flows in the coil, it generates a time-varying, horizontal magnetic field which tends to encircle each of front and rear coil parts 31, 32.

As indicated above, however, rear coil part 32, which is composed of a non-magnetic, electrically conductive material such as copper or copper base alloy, comprises a box-like structure which encloses all of front coil part 31 except front surface 33. Accordingly, because the structure enclosing front coil part 31 is non-magnetic, the horizontal magnetic field is substantially confined to the space in front of front surface 33 of front coil part 31, at open side 26 of gap 25, and the magnetic field is not dissipated in a direction away from open side 26 of gap 25.

Further, as stated above, lower body portion 35 has a shape that conforms substantially to open side 26 of gap 25. As a result, both (a) the density of the current flowing in lower body portion 35 and (b) the intensity of the magnetic field along front coil part 31 (a parameter which is proportional to current density) increase in a downward direction along front coil part 31. Thus, the coil produces a magnetic confining pressure that increases in a downward direction to match the increasing static pressure urging the molten metal out of open side 26 of gap 25.

Fins 44 serve to distribute the magnetic flux, which encircles that portion of front coil part 31 behind front surface 33, over substantially the entire area of each horizontal planar space 45. The total amount of magnetic flux in front of front surface 33 (at open side 26 of gap 25) and the total amount of flux behind front surface 33 are the same. The flux in front of front surface 33 is concentrated there. The flux behind front surface 33 is spread out over an area corresponding to the area of planar spaces 45. As a result, the flux density at open side 26 of gap 25, at any given vertical level of open side 26, is relatively greater than the flux density in any space 45 at the same vertical level.

Magnetic flux naturally tends to penetrate or diffuse through the surfaces of front coil part 31. The polarity of the magnetic field which encircles front and rear coil parts 31, 32 varies sinusoidally in conformity with the changing polarity of the alternating current flowing in coil 30. Therefore, according to the skin effect (a phenomenon well-known to those of ordinary skill in the art), the magnetic flux only has time to penetrate a small depth into the surfaces of coil 30 and, in particular, into the surfaces of lower body portion 35 before the flux changes polarity. However, the magnetic flux diffusing into front surface 33 of lower body portion 35 is more concentrated than the magnetic flux diffusing into side surfaces 41, 42 and rear surface 43. This is so because the flux is concentrated in front of front surface 33, at open side 26 of gap 25.

The distribution or concentration of current in various parts of lower body portion 35 is related to the concentration of magnetic flux at those parts. Accordingly, the current is concentrated in front surface 33, where the flux is most concentrated.

Due to the skin effect, current flowing downwardly through lower body portion 35 flows into fins 44 where current flow is substantially confined within one skin depth of each of the surfaces of fins 44. In other words, because the high-frequency current conducted through coil 30 tends to flow along the surfaces of coil 30, the current will flow downwardly along front surface 33 and along side and rear surfaces 41–43 of lower body portion 35, except at those vertical positions along lower body portion 35 where a fin 44 is present. At those positions, the current will flow outwardly along the top surface of the fin, downwardly along the edge surfaces of the fin, and inwardly along the bottom surface of the fin to return to lower body portion 35.

Fins 44 have a vertical thickness approximately four times as great as the skin depth of the material of which coil 30 is composed. Dimensioning fins 44 in this manner ensures that most of the current flows primarily along the surfaces of fins 44, as described above, rather than flowing directly through lower body portion 35. Because current is thus distributed along the surfaces of fins 44, the magnetic flux in planar spaces 45 (the distribution of which is related to the distribution of current) is spread out over the entire area corresponding to each planar space 45.

The skin depth, of the material of which coil 30 is composed, varies inversely with the frequency of the alternating current flowing in coil 30. As noted above, the thickness of fins 44 must be approximately four times the skin depth in order for current to flow substantially along the surfaces of fins 44. Therefore, the frequency of the current flowing in coil 30 must be high enough to produce a skin depth small enough that fins 44 can be about four skin depths thick, as described above, while permitting proper dimensioning of planar spaces 45 vertically separating fins 44.

Generally, planar spaces 45 are dimensioned to ensure that the magnetic flux density in planar spaces 45 is approximately constant throughout planar spaces 45. Specifically, the vertical dimension of each space 45 is between approximately fifty and approximately one hundred percent of the front-to-back thickness of lower body portion 35 (i.e., the distance from front surface 33 to rear surface 43 of lower body portion 35).

The exact dimensioning of planar spaces 45 depends upon several considerations, however. Magnetic flux density near a fin 44 varies inversely with distance from the fin. Moreover, at small distances from the fin, magnetic flux density is approximately constant. Thus, if planar spaces 45 separating fins 44 are sufficiently thin, the magnetic flux density in planar spaces 45 will be approximately constant as desired. Otherwise, the flux density will decrease toward the vertical center of each planar space 45. Where this occurs, the magnetic confining pressure exerted by coil 30, at open side 26 of gap 25, will also decrease. It is, therefore, desirable for planar spaces 45 to be thin.

If planar spaces 45 are too thin, however, the inductance between fins 44 (which is proportional to the distance between fins) will also be small so that a greater portion of the total current flowing in coil 30 would flow along the surfaces of fins 44 than if planar spaces 45 are dimensioned properly. That, in turn, would reduce the portion of the total current that is concentrated in front surface 33 and would reduce the corresponding concentration of magnetic flux at open side 26 of gap 25. In other words, if planar spaces 45 are too thin, the coil will be inefficient.

In summary, fins 44 must be thick enough to ensure that current will flow substantially along the surfaces of fins 44. The vertical dimension of planar spaces 45 must be small enough that the magnetic flux density is approximately constant throughout each planar space 45, and large enough that most of the current is substantially concentrated in front surface 33.

At a typical operating current frequency of 3000 Hertz, for example, the skin depth in fins composed of copper is approximately 1.2 mm. Fins 44 must therefore exceed approximately 4.8 mm in vertical thickness. In this same embodiment, adjacent fins 44 are vertically separated at intervening planar space 45 by approximately 12.5 mm.

Because fins 44 effectively lengthen the path through which current flows in front coil part 31 (i.e., current flows along the surfaces of fins 44), fins 44 increase the resistance to current flow through lower body portion 35 and, therefore, reduce the amount of current flowing through coil 30. Therefore, it would be desirable to keep the number of fins 44 as low as possible, while providing enough fins to spread out the magnetic flux behind lower body portion 35.

The above-discussed thickness and spacing of fins 44 tends to concentrate current in front surface 33 of lower body portion 35. As a result, the magnetic field generated at open side 26 of gap 25 is more concentrated than the magnetic field would be if the current were uniformly distributed in lower body portion 35.

In addition, the downwardly increasing concentration of current flowing in front coil part 31 due to the downwardly tapering contour thereof further enhances the magnetic field and magnetic flux density at open side 26 of gap 25 near nip 28, as explained above.

The increased flux density at open side 26 of gap 25 enables coil 30 to exert a magnetic confining pressure on the molten metal in gap 25 that is relatively stronger, for a given amount of current flowing in the coil, than the pressure that could be exerted by a coil without fins.

Referring now to FIGS. 12, 13, and 14, in a variant of the present invention, pieces of magnetic material 70, 72, 74 may be placed in planar spaces 45 vertically separating adjacent fins 44. Individual pieces of magnetic material 70, 72, 74 may be horizontally separated by air gaps 71, 73 which are inherently less effective in conducting magnetic flux than is magnetic material.

The geometric configuration of magnetic material pieces 70, 72, 74 and intervening air gaps 71, 73 may be designed to maximize the dispersion of magnetic flux throughout planar spaces 45 between adjacent fins 44. Thus, the total magnetic flux is distributed over a larger area in planar spaces 45 than it is in the embodiment that does not employ pieces of magnetic material 70, 72, 74 in planar spaces 45. As the area of magnetic flux distribution increases, the magnetic flux density in magnetic material pieces 70, 72, 74 decreases. Consequently, the energy loss in magnetic material pieces 70, 72, 74 (which is proportional to magnetic flux density) also decreases.

Although pieces of magnetic material 70, 72, 74 produce the same types of energy losses as were produced by magnetic material enclosing the sides and back of the front half of the coil disclosed in parent application Ser. No. 07/902,559 (hereafter the "earlier coil"), the energy losses in magnetic material pieces 70, 72, 74 are much less than the losses in the earlier coil. Therefore, in the embodiment of FIGS. 12–14, an enhanced magnetic field is produced by fins 44, but the energy losses in the form of generated heat are lower than those associated with the earlier coil. Because the coil of the present invention generates less heat than the earlier coil, the present coil can conduct a larger current and produce a stronger magnetic confining pressure than the earlier coil which uses magnetic material, but not fin structures, to concentrate current in the working surface.

A cooling channel 50 is provided in front coil part 31 and extends from top surface 38 of neck 37 through neck 37, upper body structure 36, and lower body portion 35, to bottom surface 39 of coil 30 (FIG. 8). Cooling fluid is circulated through cooling channel 50 in order to cool front coil part 31. Heat generated by the current concentrated in front surface 33 of front coil part 31 is also dissipated by fins 44. Rear coil part 32 may be cooled, as shown in FIG. 4, by circulating cooling fluid through cooling tubes 51 (only one of which is shown) attached to rear coil part 32.

FIGS. 15–18 illustrate another embodiment of the present invention wherein an apparatus indicated generally at 120 is positioned adjacent an open side 126 of a gap 125 between a pair of rolls 121, 122, similar to the positioning of apparatus 20 described above. Apparatus 120 exerts a confining pressure, in a manner similar to that described in connection with apparatus 20, against the molten metal in gap 125, except for such differences as are noted below.

Apparatus 120 comprises a single turn coil 130 including a front coil part 131 integrally connected to a rear coil part 132. Rear coil part 132 is very similar to rear coil part 32 described above but differs in some respects from rear coil part 32 as described below. Rear coil part 132 includes walls 160 165 as well as walls 167–169 of collar 166 integrally connected thereto. Front coil part 131 is similar to front coil part 31 described above but differs in some respects from front coil part 31 as described below.

Front coil part 131 comprises an upper body portion 134 and a lower body portion 135. Upper body portion 134, in turn, comprises a rectangular, mostly solid upper body structure 136 from which a neck 137 extends upwardly and integrally. Neck 137, upper body structure 136, and lower body portion 135 have respective front surface portions which are contiguous and coplanar so as to form an uninterrupted front surface 133. As shown in FIG. 15, lower body portion 135 extends downwardly from upper body structure 136 and has a lateral width which decreases in a downward direction in conformity with the narrowing in width of open side 126 of gap 125.

Lower body portion 135 has two opposed side surfaces 141, 142 and a rear surface 143. Contiguous with and extending laterally outward from side surfaces 141, 142 and rearward from rear surface 143 are a plurality of fins 144 vertically separated by planar Spaces 145. Fins 144 are planar members that are integral with lower body portion 135, like fins 44 and lower body portion 35 in coil 30 described above.

Figure 18:
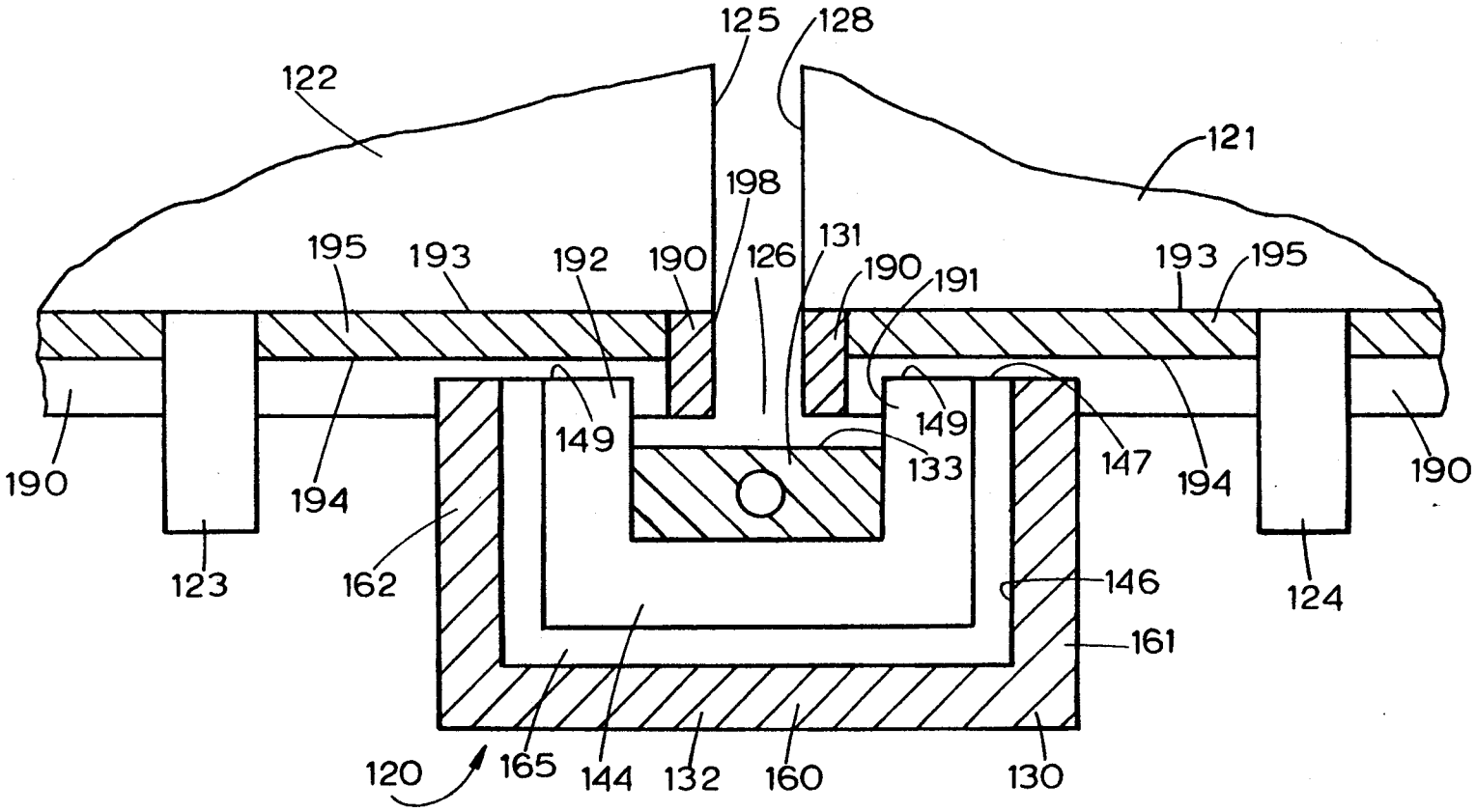
FIG. 18 is an enlarged view of a portion of FIG. 16.

In this embodiment, however, each fin 144 comprises first and second portions 191, 192 which are disposed on opposite flanks of front surface 133 and which project forward of front surface 133 toward respective rolls 191, 192 (FIGS. 16 and 18). Therefore, front surface 133 is not contiguous and coplanar with the front edge surfaces 149 of fins 144 as front surface 33 is with the front edge surfaces of fins 44 in coil 30. Rather, front surface 133 is recessed relative to surfaces 149 on first and second portions 191, 192 of fins 144.

Walls 160–165 of rear coil part 132 define a cavity 146 that has front opening 147 for receiving front coil part 131 (FIGS. 15 and 16). Front surface 133 of front coil part 131 remains uncovered by rear coil part 132 and faces open side 126 of gap 125 through front opening 147 of cavity 146 (FIG. 16). Cavity 146 is larger than front coil part 131, however, so that fins 144 do not contact the inner surfaces of walls 160–165 of rear coil part 132 (FIGS. 15 and 16).

Front edge surfaces 149 of first and second portions 191, 192 of fins 144 are coplanar with front opening 147 of cavity 146. Front coil part 131 is disposed within cavity 146, and front surface 133 of front coil part 131 is recessed with respect to front opening 147 of cavity 146 (FIGS. 15 and 18).

For use with apparatus 120, an annular lip 190 is secured to each end surface 193 of each roll 121, 122. Each lip 190 has an outer diameter equal to that of roll 121, 122 and extends outwardly from each end surface 193 of a roll in a direction parallel to the roll axis at 123 or 124. Each lip 190 has an inner diameter such that the thickness of the lip is less than substantially one skin depth of the material of which lip 190 is composed at the particular frequency of the current flowing in coil 130. Each lip 190 also defines the rim of an annular space 194 having an outer opening and an inner surface corresponding to roll end surface 193.

Each lip 190 also has an outer circumferential surface constituting a longitudinal extension of the circumferential casting surface of the roll (121 or 122) to which the lip is attached. Pairs of lips 190, counterrotating together with respective rolls 121 and 122, thus define a longitudinal extension 198 of gap 125. Accordingly, open side 126 of gap 125 is actually located at the open end of longitudinal gap extension 198 which, in this embodiment, is a part of gap 125 (FIG. 16). Naturally, static pressure urges the molten metal in gap 125 into longitudinal gap extension 198 from which, but for coil 130, the molten metal would escape through open side 126.

Each gap extension 198 is substantially one to substantially three times as long, and preferably about twice as long, as the skin depth of the particular molten metal being confined at the particular frequency of the current flowing in the coil. This dimensioning of extensions 198 ensures that sufficient magnetic flux is coupled with the molten metal to confine the molten metal in gap 125.

The amount of magnetic flux that can couple with the molten metal in gap 125 varies with the length of gap extensions 198 (and of annular spaces 194 into which portions 191, 192 of fins 144 protrude). If gap extensions 198 are too short, too little magnetic flux couples with the molten metal to produce a confining pressure sufficient to prevent escape of molten metal from gap 125. More total current is then required to enable coil 130 to couple enough magnetic flux to confine the molten metal.

If extensions 198 are too long, ample flux couples with the molten metal, but energy losses in the molten metal are unnecessarily high, and coil 130 is inefficient.

In this embodiment, the length of a cavity extension 198 typically is between approximately 1.5 and approximately 3 skin depths for the material of which lips 190 are composed at the frequency of the current flowing in coil 130. At a frequency of 3000 Hertz, for example, the length of each cavity extension 198 is substantially between sixteen and thirty-four millimeters (for lips 90 composed of steel).

Because portions 191, 192 of fins 144 project forward beyond front surface 133, forward projecting first and second fin portions 191, 192 and coil front surface 133 effectively define a recess 196 (FIG. 15). Coil 130 is positioned sufficiently close to rolls 121, 122 that an arc or segment of each circumferential lip 190 enters into recess 196 (FIGS. 16 and 18).

Referring to FIG. 15, in order to permit such entry of segments of lips 190 into recess 196, top wall portions 163, 164 and bottom wall 165 of rear coil part 132 are notched to receive those segments of lips 190. Each top wall portion 163, 164 includes a notch 183, 184 that is sized to allow a segment of a lip 190 to enter recess 196 without contacting top wall portion 163 or 164. Further, bottom wall 165 includes a notch 185 that is sized to allow a segment of a lip 190 on each roll 121, 122 to enter recess 196 without contacting bottom wall 163.

Moreover, to maximize the increase in flux penetration into the molten metal (made possible by lips 190 entering recess 196), the distance that portions 191, 192 of fins 144 project forward of front surface 133 is approximately the length of cavity extensions 198. Lips 190 do not contact coil 130, however; and portions 191, 192 of fins 144 do not contact end surfaces 193 of rolls 121, 122 (or the annular discs, described below, that substantially cover end surfaces 193 of rolls 121, 122).

Lips 190 are composed of a non-magnetic material having a low electrical conductivity. This composition enables the magnetic flux generated by coil 130 to extend through those segments or arcs of lips 190 that are within recess 196 at any given rotational orientation of rolls 121, 122 (those segments obviously change as rolls 121, 122 rotate). The magnetic flux extending through those particular segments of lips 190 can then penetrate more deeply into, and magnetically couple more effectively with, the molten metal in gap 125 and longitudinal gap extensions 198 than if fins 144 did not project forward beyond front surface 133. This configuration therefore enables coil 130 to exert a stronger confining pressure on the molten metal than the coil could exert if portions 191, 192 of fins 144 did not project forward beyond front surface 133.

An annular disc 195 substantially covers each end surface 193 of each roll 121, 122. Each end surface 193 is also the inner surface of a respective annular space 194. Each disc 195 is composed of copper or other nonmagnetic material and therefore confines the magnetic field to the annular space 194 within lip 190 at each end of each roll 121, 122. In other words, the magnetic flux in annular space 194 does not penetrate end surface 193 of roll 121 because it is confined by nonmagnetic disc 195.

The confinement of magnetic flux in annular spaces 194 at ends 193 of rolls 121, 122 increases the concentration of magnetic flux at open side 126 of gap 125 and increases the strength of the confining pressure exerted upon the molten metal in gap 125 and gap extensions 198.

Except for the aspects discussed above, coil 130 is identical in structure and function to coil 30.

The foregoing detailed description has been given only to illustrate the concept of the present invention, and no unnecessary limitations should be understood therefrom, as modifications will be obvious to those skilled in the art.

I claim:

1. A magnetic confining apparatus for preventing the escape of molten metal through the open side of a vertically extending gap between two horizontally separated members and in which the molten metal is located, said apparatus comprising:

nonmagnetic, electrically conductive coil means for conducting an electric current, adjacent the open side of said gap, for directly generating a horizontal magnetic field which extends through the open side of said gap to said molten metal and exerts a confining pressure against the molten metal in the gap;

said coil means being disposed sufficiently close to the open side of said gap to confine said magnetic field substantially to the open side of said gap;

said coil means comprising a front coil part relatively near to the open side of said gap and a rear coil part relatively remote from the open side of said gap;

said front coil part comprising a front surface portion facing the open side of said gap and current concentrating means for concentrating an electric current flowing in said front coil part substantially in said surface portion of said front coil part, wherein said current concentrating mean comprises:

a plurality of vertically spaced fin-like structures disposed on said front coil part, extending rearwardly outward behind said surface portion and extending laterally outward on each side of the surface portion;

each fin-like structure having fin surfaces.

2. An apparatus as recited in claim 1 wherein said coil means is intended for operation with an electric current having a predetermined frequency, and wherein:

a portion of said current flows within said fin-like structures; and said fin-like structures have a thickness which is sufficiently large to ensure that said current flowing in said fin-like structures, at said predetermined frequency, flows substantially along said fin surfaces.

3. An apparatus as recited in claim 2, and wherein:

said thickness of said fin-like structures exceeds substantially four times the skin depth for the material of said coil at said predetermined frequency.

4. An apparatus as recited in claim 1 and wherein:

said front coil part has a front-to-back thickness;

each pair of adjacent fin-like structures is vertically separated by a planar space having a vertical dimension; and said vertical dimension is between about fifty and about one hundred percent of the front-to-back thickness of said front coil part.

5. An apparatus as recited in claim 1 wherein:

said fin-like structures each comprise first and second portions disposed on opposite flanks of said surface portion; and said first and second portions each project forward of the surface portion toward one of said horizontally separated members.

6. In combination with the magnetic confining apparatus as recited in claim 6, a molten metal continuous casting system comprising:

two horizontally disposed members defining a vertically extending gap that has an open side at each end thereof;

each of said two horizontally separated members having a pair of opposed end surfaces and a circumferential lip extending from each end surface;

each lip defining a rim of an annular recess having an outer open end and an inner surface corresponding to the end surface from which the lip extends.

7. A combination as recited in claim 6 wherein:

said first and second forward projecting portions each extend into a respective annular recess through the outer open end thereof.

8. A combination as recited in claim 6 wherein each circumferential lip is composed of a nonmagnetic material.

9. A combination as recited in claim 6 wherein each of said horizontally separated members comprises:

a non-magnetic annular disc disposed on an end surface of said member and substantially covering said end surface.

10. An apparatus as recited in claim 1 and comprising:

an electrically conductive shield comprising means for confining said magnetic field to a region substantially between said surface portion and the open side of said gap.

11. An apparatus as recited in claim 10 wherein:

said electrically conductive shield constitutes the rear coil part.

12. An apparatus as recited in claim 11 wherein:

said electrically conductive shield defines a cavity in which the front coil part is located; and said surface portion of said front coil part is exposed through a forward-facing opening in said cavity.

13. An apparatus as recited in claim 1 and for preventing the escape of molten steel, and wherein:

said coil means is composed of copper or copper base alloy.

14. An apparatus as recited in claim 1 and comprising:

means, including the configuration of the surface portion of said front coil part, for increasing the magnetic pressure associated with said magnetic field in conformity with increasing static pressure of the molten metal in said gap.

15. An apparatus as recited in claim 14 wherein:

said surface portion of said front coil part has a lateral width which narrows downwardly along the vertical dimension of said front coil part in conformity with a narrowing in the width of the open side of said gap, so that, when current flows through said coil, the current density in said surface portion increases with decreasing width of said surface portion.

16. An apparatus as recited in claim 15 wherein:

said surface portion of said front coil part has a shape conforming substantially to the shape of the open side of said gap.

17. An apparatus as recited in claim 1 wherein said two horizontally separated members are rotatable rolls having parallel axes and peripheral side edges defining the open side of said gap and wherein:

said front coil part faces the open side of said gap; and said rear coil part comprises means located behind said front coil part and which is more remote from the open side of said gap than said front coil part.

18. An apparatus as recited in claim 17 wherein:

said front coil part has a pair of side walls and a rear wall each extending between upper and lower ends of the front coil part.

19. An apparatus as recited in claim 17 wherein:

said coil comprises means conductively connecting said front coil part and said rear coil part adjacent an end of each.

20. An apparatus as recited in claim 19 wherein:

said connecting means comprises a bottom portion of said rear coil part;

said bottom portion being integral with said front coil part.

21. An apparatus as recited in claim 17 wherein:

at least said front coil part has a hollow interior defining a passage through which a cooling fluid may be circulated.

22. An apparatus as recited in claim 1; wherein:

said front coil part comprises an upper portion and a lower portion;

said lower portion having a pair of opposed side surfaces and a rearward facing surface which faces away from the open side of said gap;

said upper and lower portions each having a forward facing surface;

said forward facing surfaces of said upper and lower portions being contiguous and coplanar and defining an uninterrupted surface;

said uninterrupted surface constituting said surface portion of said front coil part.

23. An apparatus as recited in claim 22 wherein said fin-like structures extend outwardly from said opposed side surfaces and from said rearward facing surface of said lower portion.

24. An apparatus as recited in claim 23 wherein:

said fin-like structures comprise planar members disposed on said lower portion of the front coil part and extend away from the open side of said gap.

25. An apparatus as recited in claim 23 wherein:

said fin-like structures are integral with the front coil part.

26. An apparatus as recited in claim 23 wherein:

said gap has a narrowest part where said horizontally separated members are closest together; and said apparatus is positioned adjacent the open end of said gap so that said fin-like structures are disposed both above and below the narrowest part of said gap.

27. An apparatus as recited in claim 23 and comprising:

means, composed of magnetic material, disposed between adjacent fin-like structures.

28. An apparatus as recited in claim 27 wherein:

said means composed of magnetic material comprises a plurality of pieces of magnetic material; and each of said pieces of magnetic material lies in the same plane and is separated from other pieces by an air gap.

29. In combination with the magnetic confining apparatus as recited in claim 1, a molten metal continuous casting system comprising:

two horizontally disposed members defining a vertically extending gap;

said gap having an open side at each end thereof;

said magnetic confining apparatus substantially abutting an open side of said gap.

30. A magnetic confining method for preventing the escape of molten metal through the open side of a vertically extending gap between two horizontally separated members between which said molten metal is located, said method comprising the steps of:

providing a current-conducting coil, comprising at least a front coil part and a rear coil part, adjacent the open side of said gap, with a front surface portion of the front coil part facing the open side of said gap;

conducting electric current through said coil to generate a horizontal magnetic field which extends through the open side of said gap to said molten metal and exerts a confining pressure against the molten metal in said gap;

concentrating the flow of electric current in said front surface portion by employing a plurality of vertically spaced, fin-like structures having fin surfaces and being disposed on said front coil part, extending rearwardly outward behind said front surface portion and extending laterally outward on each side of the front surface portion; and confining said magnetic field substantially to the open side of said gap.

31. A method as recited in claim 30 and comprising:

increasing the magnetic pressure associated with said magnetic field in conformity with increasing static pressure of the molten metal in said gap.

32. A method as recited in claim 30 and comprising:

maximizing the dispersion of magnetic flux in the spaces between adjacent, vertically spaced, fin-like structures by disposing magnetic material in each of said spaces.

33. A method as recited in claim 32 wherein:

said magnetic material comprises a plurality of pieces of magnetic material, each of said pieces of magnetic material lying in the same plane and being separated from other of said pieces of magnetic material by an air gap.

34. A method as recited in claim 30 wherein said front coil part has a pair of side surface portions, each on a respective opposite side of said front surface portion, and a rear surface portion behind said front surface portion, said method comprising:

employing a pre-determined frequency for said electric current; and employing a thickness for said fin-like structures that ensures that current flowing in the fin-like structures, at said predetermined frequency, flows substantially along said fin surfaces.

35. A method as recited in claim 30 comprising:

employing a thickness for said fin-like structures that is substantially four times the skin depth for the material of said coil at said predetermined frequency.

* * * * *

UNITED STATES PATENT AND TRADEMARK OFFICE

CERTIFICATE OF CORRECTION

PATENT NO. : 5,279,350

DATED : January 18, 1994

INVENTOR(S) : Howard L. Gerber

It is certified that error appears in the above-identified patent and that said Letters Patent is hereby corrected as shown below:

| | |
|---|---|
| Col. 4, line 26, | "variance" should be --variant--. |
| Col. 6, lines 38-39, | "60.65" should be --60-65--. |
| Col. 6, line 63, | "a" should be --as--. |
| Col. 10, line 40, | "160 165" should be --160-165--. |
| Col. 10, line 62, | "Spaces" should be --spaces--. |

In the Claims:

| | |
|---|---|
| Col. 13, line 67, | "claim 6" should be --claim 5--. |
| Col. 15, line 17, | ";" should be --,--. |

Signed and Sealed this

Fifth Day of July, 1994

*Attest:*

Bruce Lehman

BRUCE LEHMAN

*Attesting Officer*

*Commissioner of Patents and Trademarks*